United States Patent [19]

Jones et al.

[11] 3,930,725

[45] Jan. 6, 1976

[54] MULTIPLE SHEET FEEDING SYSTEM FOR ELECTROSTATOGRAPHIC PRINTING MACHINES

[75] Inventors: Hugh L. Jones, Rochester; James W. Van Deluyster, Fairport, both of N.Y.

[73] Assignee: Xerox Corporation, Stamford, Conn.

[22] Filed: Mar. 27, 1974

[21] Appl. No.: 455,433

Related U.S. Application Data

[63] Continuation of Ser. No. 284,830, Aug. 30, 1972, abandoned.

[52] U.S. Cl. ..... 355/14; 101/242; 271/9

[51] Int. Cl.[2] ..... G03G 15/00

[58] Field of Search ..... 355/3, 14; 271/9, 230; 101/232, 242

[56] References Cited

UNITED STATES PATENTS

| | | | |
|---|---|---|---|
| 1,007,008 | 10/1911 | Roesen | 271/9 |
| 1,991,003 | 2/1935 | Stevens | 271/230 |
| 3,490,842 | 1/1970 | Reick et al. | 355/10 |
| 3,630,607 | 12/1971 | Korn et al. | 355/14 X |
| 3,698,706 | 10/1972 | Mihojevich et al. | 271/9 |

*Primary Examiner*—Joseph F. Peters, Jr.
*Assistant Examiner*—Kenneth C. Hutchison

[57] ABSTRACT

An electrostatographic printing machine employing sheet conveyance along a path through the machine from a plurality of supply sources to a sheet output delivery point. An individual conveyor mechanism is adapted to convey sheets to a common sheet registration mechanism associated with the conveyor mechanism for one of the supply sources. The registration mechanism serves as a control element in the machine processing programming system which includes the feeding of sheets from the individual supply sources, and the processing events for the production of electrostatic latent images and the transfer thereof to the sheets.

3 Claims, 10 Drawing Figures

MULTIPLE SHEET FEEDING SYSTEM FOR ELECTROSTATOGRAPHIC PRINTING MACHINES

This is a continuation of U.S. application Ser. No. 284,830, filed Agu. 30, 1972 now abandoned.

This invention relates to electrostatographic printing machines, and in particular to a unique configuration of a plurality of sheet supply sources and a sheet registration mechanism which controls the programming of machine processing.

Electrostatic printing machines of the type utilizing reusable photoreceptor elements employ various processing stations which will uniformly charge, expose, develop, transfer, fuse, clean, etc. during any cycle of copying. Where it is desired to utilize multiple sheet supply sources, and without introducing or increasing paper jamming prospects, while at the same time insuring efficient machine processing while using any of the sheet sources, it becomes very important that there be a common base for the timing sequence of operation of the processing stations. There must be provision for the efficient and assured movement of copy sheets from any of the paper supplies to the transfer station of the machine in timed sequence relative to the production of electrostatic latent images, the development thereof, the proper orientation of each sheet to the developed image received at the transfer station, the commencing of energization for all the corotrons used in the machine, the fusing apparatus, and all the sensing elements utilized for sheet presence monitoring for paper jam detection.

Therefore, the principal object of the present invention is to improve electrostatographic printing machines of the type employing electrostatic photoreceptor elements.

Another object of the present invention is to utilize multiple sheet feed mechanisms while maintaining proper timing of the operation of the electrostatic processing stations utilized in the machine so as to effect maximum efficiency in the operation of the machine especially for high speed reproduction.

The foregoing objects are attained by the provision of a plurality of paper supply stacks each having associated therewith a sheet feed mechanism adapted to separate and move a sheet of paper to a conveyor for that particular stack, and to convey the sheets to a common registration mechanism. The registration mechanism includes a switching device which is associated with the machine programming system wherein it is part of the timing control for the machine operational sequence. Regardless which of the sheet supply arrangements is utilized, machine timing and operation are unaffected, and the programming sequence is accomplished under the same controlling components. That is, there is provided a single registration system, which may be devised in accordance with the machine processing program, for a plurality of paper supply stacks. In this manner, various machine accessories such as sorters, finishing stations and automatic document handling devices may be integrated into the machine and arranged to be usable with the plurality of sheet stacks and their respective sheet feed mechanisms. A production run may typically be programmed whereby each of two or more sheet supply stacks differing perhaps in paper color, or size, or in pre-printed content may be brought into play to produce sets of reproduced material having differing variations in paper format. One of the paper stacks may include heavier weight stock for use as covers for the sets, or as dividers between ordinary copy sheets in each set.

These and other objects will become apparent after reading the following specification in conjunction with the drawings wherein.

Figure 1:
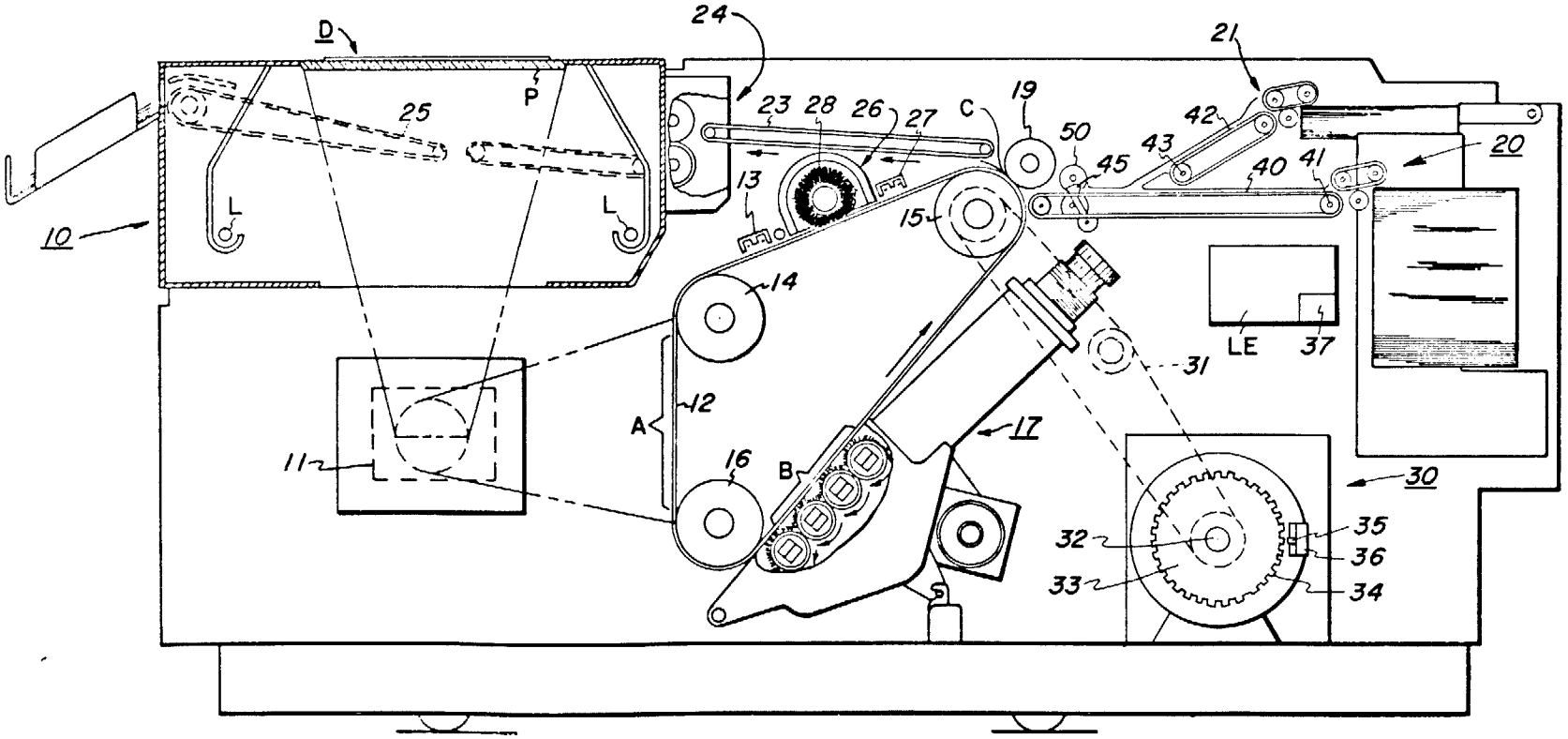
FIG. 1 is a schematic sectional view of an electrostatic reproduction machine embodying the principles of the invention.
Figure 2:
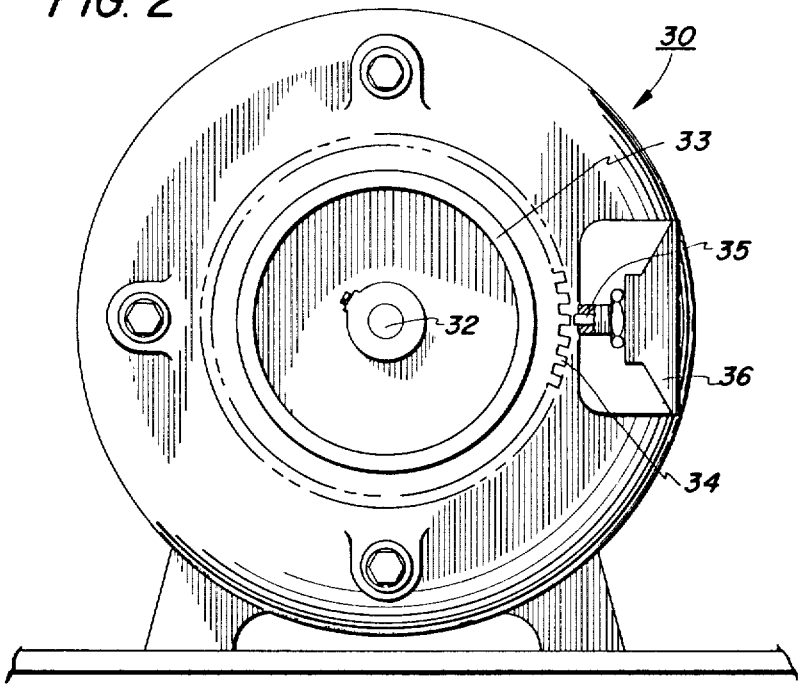
FIG. 2 is a front elevational view of the drive motor for the machine.

For a general understanding of an electrostatic processing system in which the invention may be incorporated, reference is had to the drawings wherein various components of a system are schematically illustrated. For purposes of illustration only, the type of printing machine described for the environment of the present invention is of the electrostatic type; and particularly one that is based on the process of xerography. In most electrostatic systems, such as a xerographic machine of the type illustrated, a light image of an original to be reproduced is projected onto the sensitized surface of a xerographic plate to form an electrostatic latent image thereon. For purposes of providing an environment for the present invention and therefore, for illustration purposes only, the illustrated xerographic system is of the type wherein the xerographic plate is in the form of an endless belt. In a belt type environment, the present invention is also adapted for integration into a belt type machine wherein the belt is a conveying element per se rather than a form of photoreceptor, and sheets of photoconductive material are positioned upon the belt for movement through processing stations. Thereafter, the latent image is developed by means of a magnetic brush developing apparatus to form a xerographic powder image, corresponding to the latent image on the plate surface. The powder image is then electrostatically transferred to a support surface to which it may be fixed by a fusing apparatus whereby the powder image is caused permanently to adhere to the support surface.

The electrostatically attractable developing material commonly used in magnetic brush developing apparatus comprises a pigmented resinous powder referred to here as "toner" and a "carrier" of larger granular beads formed with steel cores coated with a material removed in the triboelectric series from the toner so that a triboelectric charge is generated between the toner powder and the granular carrier. The magnetizable carrier also provides mechanical control for the formation of brush bristles by virtue of magnetic fields so that the toner can be readily handled and brought into contact with the exposed xerographic surface. The toner is then attracted to the electrostatic latent image from the carrier bristles to produce a visible powder image on an insulating surface.

In the illustrated machine, an original D to be copied is placed upon a transparent support platen P fixedly arranged in an illumination assembly generally indicated by the reference numeral 10. While upon the platen, an illumination system comprising two or more lamps and reflectors L are flash energized so as to flash light rays upon the original thereby producing image rays corresponding to the informational areas on the original. The image rays are projected by means of an optical system 11 to an exposure station A for exposing the photosensitive surface of a moving xerographic plate in the form of a flexible photoconductive belt 12. In moving in the direction indicated by the arrow, prior to reaching the exposure station A, that portion of the belt being exposed would have been uniformly charged by a corona device 13 located at a belt run extending between belt supporting rollers 14 and 15, the latter being the drive roller for the belt. The exposure station extends between the roller 14 and a third support roller 16, and the belt run between these rollers is encompassed entirely by the exposure station for minimizing the space needed for the belt and its supporting rollers.

The exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes around the roller 16 and through a developing station B located at a third run of the belt and in which there is positioned a developing apparatus generally indicated by the reference numeral 17. Suitable means (not shown) such as vacuum panels or tensioning means may be utilized for maintaining the belt flat in any or all three belt runs, and additionally the belt run related to the development zone B is maintained at an inclined plane. The developing apparatus 17 comprises a plurality of magnetic brushes which carry developing material to the adjacent surface of the upwardly moving inclined photoconductive belt 12 in order to provide development of the electrostatic image.

The developed electrostatic image is transported by the belt 12 to a transfer station C located at a point of tangency on the belt as it moves around the drive roller 15 whereat a sheet of copy paper is moved at a speed in synchronism with the moving belt in order to accomplish transfer of a properly registered developed image. There is provided at this station a transfer roller 19 which is arranged on the frame of the machine for contacting the non-transfer side of each sheet of copy paper as the same is brought into transfer engagement with the belt 12. The roller 19 is electrically biased with sufficient voltage so that a developed image on the belt 12 may be electrostatically transferred to the adjacent side of a sheet of paper as the same is brought into contact therewith.

There is also provided a copy sheet supplying apparatus comprising a main paper feed supply 20 and an auxiliary paper feed supply 21. Each of the paper supplies is adapted to separate sheets from their respective supply stacks seriatim and to transport the sheets to a sheet registration station and eventually into contact with the developed image on the belt as the same is carried around the drive roller 15. The programming or timing control arrangement of the present invention is operatively associated with each of the paper supply mechanisms 21, 22, the flash illumination devices L for producing an electrostatic latent image on the belt 12, to present a developed image at the transfer station C in timed sequence with the arrival of a sheet of paper, and is coordinated with the activation of other processing and control devices at the precise time that these elements are to function for their intended purposes.

After the developed image is transferred to a sheet of paper, it is stripped from the belt 12, and conveyed by a conveying system 23 into a fuser apparatus generally indicated by the reference numeral 24 wherein the developed and transferred xerographic powder image on the sheet material is permanently affixed thereto. After fusing, the finished copy is discharged from the apparatus by conveyor 25 at a suitable point for collection externally of the apparatus. The remaining toner particles remaining as residue on the developed images, and those particles otherwise not transferred are carried by the belt 12 to a cleaning apparatus 26 positioned on the run of the belt between the rollers 14, 15 adjacent the charging device 13. The cleaning device comprises a corotron 27 for neutralizing charges remaining on the particles and a rotating brush 28 which operates in conjunction with a vacuum system to remove residual toner particles from the vicinity of the brush.

In order to impart continuous movement to the belt 12, there is provided a drive means 30 comprising a constant speed drive motor and gear box which is directly coupled to the drive roller 15 by a suitable drive chain or timing belt 31 entrained around a sprocket or pulley mounted on the shaft for the roller 15 and the output shaft 32 for the drive means. The present invention provides a specific arrangement to accomplish pulse generation off of the belt drive motor, and also an entirely different arrangement for periodically resetting the pulse train to zero thereby establishing pitches. To this end, a gear 33 is mounted on the drive shaft 32 for the drive means 30 and includes a predetermined number of teeth 34, each of which becomes aligned with a magnetic pickup element 35 mounted on the frame of the machine during rotation of the gear. The element 35 is associated with a pulse generating device 36 which produces a square wave signal having peaks corresponding to the successive alignments of the teeth 34 with the pick up element 35. As each tooth moves adjacent the device 35, the magnetic field in the device is set to vary and thereby produce a peak in the signal.

Programming control for the machine processing steps is accomplished in conjunction with pitch reset wherein after a series of electrical pulses are generated corresponding to the movement of each copy sheet plus one spacing through the transfer station, reset of this number, or pitch, is accomplished when the photoreceptor belt has travelled a precise, predetermined distance - as related to the movement of a copy sheet plus one spacing. Pulse generation for a timing control signal then is accomplished by utilizing a direct connection of the photoreceptor belt 12 to the pulse generating device so as to move at all times directly therewith as described above and reset is accomplished by a reset mechanism which is reset at a predetermined position of the leading edge of each sheet of paper in proper registration to a developed image on the photoreceptor belt. With the belt continuously moving and being driven by a drive directly connected to the processing programming control, each pitch reset occurs precisely at predetermined distances of movement of the belt.

The programming control then is acquired by means of a timing device mechanically coupled to the shaft for the drive means 30 and which is driven into operation when the roller 15 is rotating. The pulse generating device 36 which is part of the timing apparatus is set to produce a continuous train of time pulses which can be determined by the rotational speed of the drive means 30 and the number of teeth 34 on the gear 33. The device 36 is electrically connected to a counting device 37 which may be in the form of a shift register mechanism which counts the pulses of the control signal. After a number of pulses have been counted, the count is restarted or set to zero which is described herein as the pitch reset. Rather than having a predetermined number of pulses cause the reset, it is preferred to utilize the distance of movement of the belt 12 as the reset causing standard. This is accomplished, as will be described hereinafter, by rotation of sheet registration fingers. Any machine event or processing step can be initiated; that is, turned "On" and "Off" or to remain operative for any period of time on any one or more of the discrete pulses. Pitch reset is accomplished during sheet registration, after each revolution of registration fingers which are arranged to be periodically interposed in the path of movement of sheets of paper just immediately prior to the insertion of each sheet into the nip of the transfer roller 19 and the belt 12 at station C.

Operatively associated with the sheet supply 20 is a sheet transport comprising a plurality of continuously movable belts 40 driven by the main drive 30 by way of rollers 41. Similarly, the sheet supply 21 is associated with a sheet transport comprising a plurality of belts 42 movably driven around rollers 43, by the machine drive 30. The driving force for the transports 40 and 42 may be accomplished by means other than the machine drive 30, such as by individual motors or a common motor. The transport 42 for the auxiliary paper supply means, when in the operative mode, transports each sheet fed thereto onto the belts 40 for the main paper supply 20. In this arrangement, each of the paper supplies is provided with its own sheet transport and one of the transports directs sheets carried thereby to the other transport so that a single sheet registration mechanism may be employed for cooperation with each of the sheet supplies.

Figure 3:
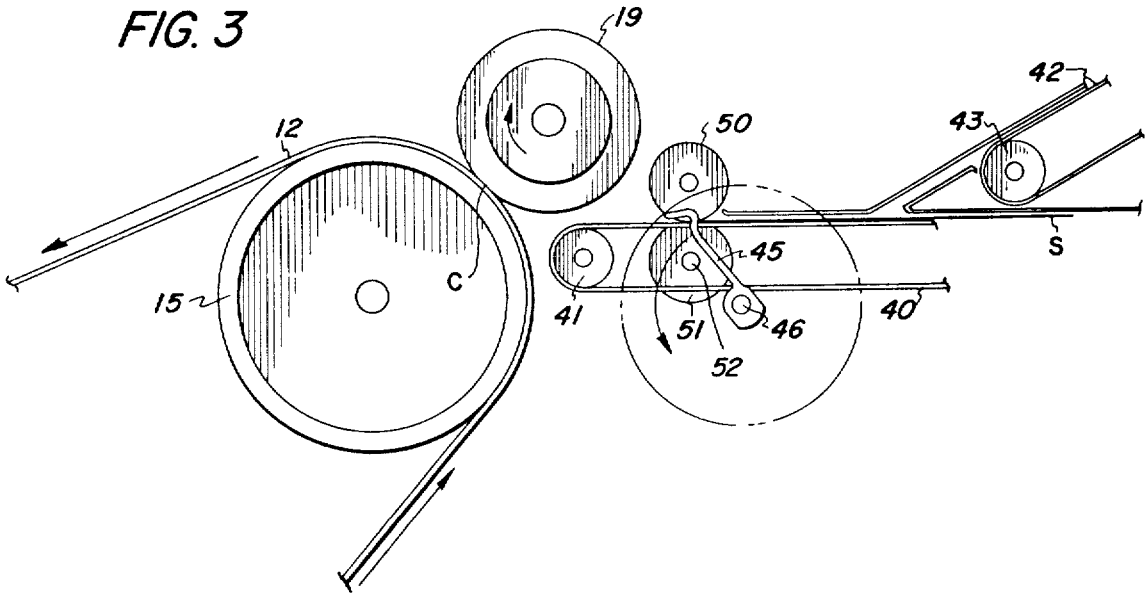
FIG. 3 is a schematic view of the paper supply transports in relation to a sheet registration arrangement.
Figure 4:
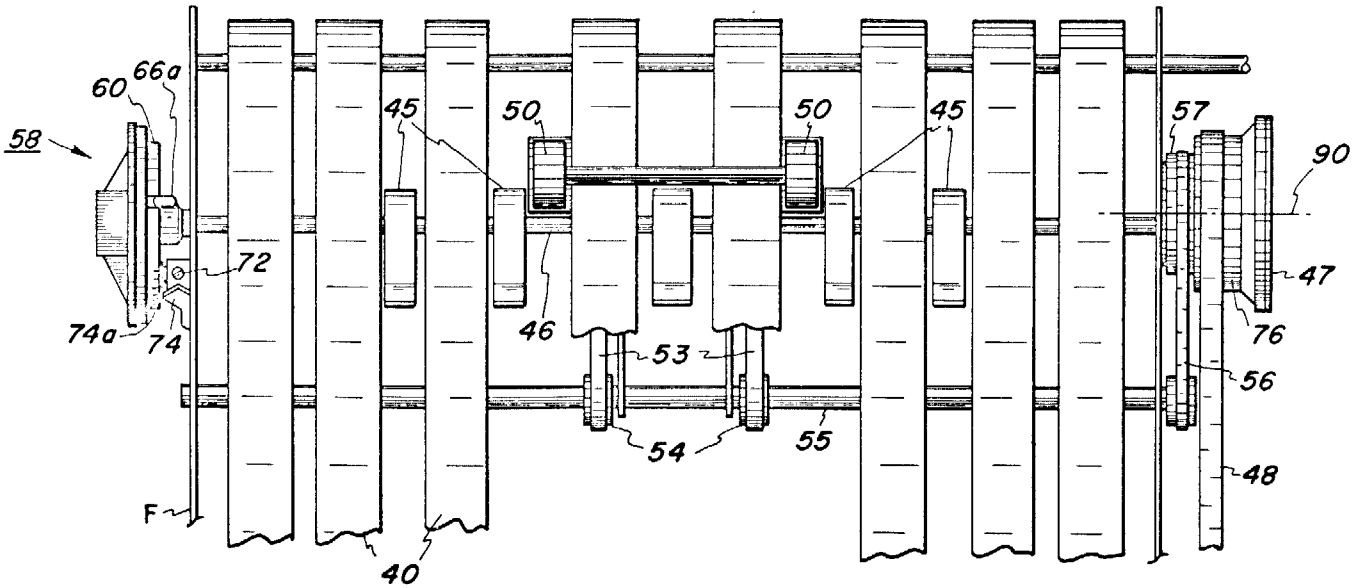
FIG. 4 is a partial plan view of one of the transports and the registration arrangement.

As shown in FIGS. 3 and 4, sheet registration is accomplished by means of a plurality of spaced registration fingers 45 mounted on a shaft 46 in alignment transversely of the paper sheet path. The shaft is suitably supported for rotation on the machine frame and is operatively connected by way of a variable speed device 47 to a drive belt 48 which in turn is operatively connected to the drive means 30 to be driven at a speed coordinated with the speed of the belt 12 and the two copy sheet transporting means 40, 42. For each complete rotation of the fingers 45 in the direction of the arrow, and when they attain the position shown in FIG. 3, a sheet S is in engagement with the fingers to become straightened in its traveling and to become positioned and timed, in other words, registered. The distance between the fingers when a sheet is registered and the nip at station C is arranged to be very small and precisely known. The instant the fingers become disengaged from each sheet, the sheets will be in the nip of a pair of driven registration pinch rollers 50, 51 and these two occurrences are utilized as the pitch reset event. The pulse occurring at that time by the counting mechanism 37 is given the designation as the zero pulse. All other pulses are counted from that event, until the next registration for the next sheet and the corresponding zero pulse. While the occurrence of the leading edge of the sheet S leaving the fingers 45 being synchronized with the entry of the edge into the nip of the pinch roller has been chosen as the instant for pitch reset, it is to be understood that other occurrences may be utilized for this purpose. For instance, the pitch reset may be made to occur when the fingers 45 are still in engagement with the leading edge of a sheet and before it reaches the nip of the pinch rollers. What is important, however, is that this precise angular positioning of the fingers for reset must be utilized for all reset occurrences. Processing control and steps are set to be actuated or energized at predetermined pulse counts from a zero pulse, and depending upon the number of pulses to be generated, say on the order to 1000 pulses or so for each sheet registration, it will be appreciated that very close and accurate process control can be attained.

The lower registration pinch rollers 51 are mounted for rotation on a shaft 52 between the belts of the belt transport 40 and the fingers 45 so as not to impede operation thereof. The shaft 52 is mounted for rotation in a frame (not shown) and is driven by belts 53 and pulleys 54 associated with a drive shaft 55 also mounted on the machine frame. One of the shafts 55 is driven by way of a belt 56 from a clutch 57 associated with the variable speed device 47. In this manner, the pinch rollers 51 are given their rotative drive by the belts 48 from the machine drive motor 30. The upper pinch rollers 50 are idler rollers having their peripheries in frictional engagement with the lower rollers 51 to be rotated therewith.

In order to effect pitch reset at the precise angular positioning of the registration fingers for each revolution thereof and to permit the recounting of pulses from each zero pulse at sheet registration, a switching mechanism 58 is provided having a switch associated therewith to be actuated to a controlling position precisely as a sheet is registered and the fingers are in a predetermined angular position.

The switching mechanism 58 comprises a circular flat housing 59 having two half sections 60 and 61, the former being suitably mounted on the machine frame and the latter secured by screws 62 to the section 60 so as to form a flat circular chamber 63 within the housing 59. In the axial center of the circular casing there is formed a central boss having an opening through which the end of the registation shaft 46 projects. Movable within the space on chamber 63 is a switch member 64 which is secured to the shaft 46 to be rotated therewith. The member 64 is arranged to be rotated within the chamber 63, and is provided with a circular magnet 65 that scribes a circular path of movement 66 around the axis of the shaft 46 during rotation thereof.

Formed integral with the supporting section 60 is a casing **66*a* having a reed switch 67 mounted therein with a hermetical seal. The switch 67 is positioned close to the flat wall of the section 60 in close proximity to the interior surface of the chamber 63. The switching elements 68 of the switch 67 have their actuating ends positioned in the circular path of movement of the magnet 65 so that for each revolution of the magnet about the axis of the shaft 46, the switch 67 will be actuated from one of its controlling conditions to the other. It will be noted that the longitudinal axes of the switch elements 68 are positioned along a chord of the circular path of movement 66 of the actuating magnet 65. This provides an acute angular relationship of these longitudinal axes and the path of movement 66 thereby as distinguished from a perpendicular relationship if the elements 68 were mounted radially. By having this acute angular relationship, more of the reed switch elements are under the influence of the magnet 65,** and there may be a greater extreme of misalignment of the parts or tolerances before adversely affecting precise operation of switching mechanisms.

Figure 5:
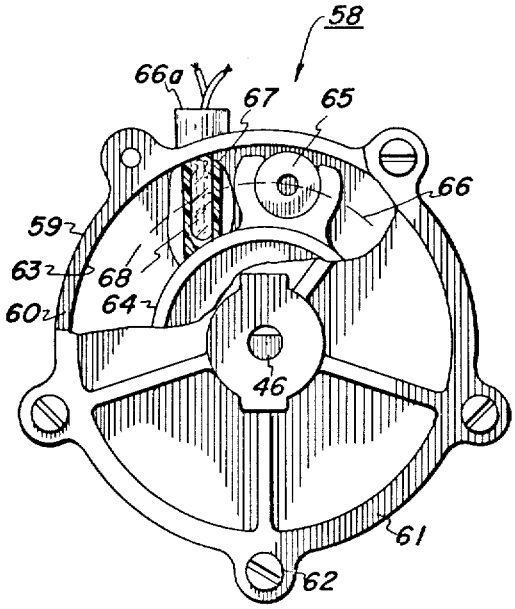
FIGS. 5 and 6 are front and side elevational views respectively of a switching mechanism utilized in sheet registration reset.
Figure 6:
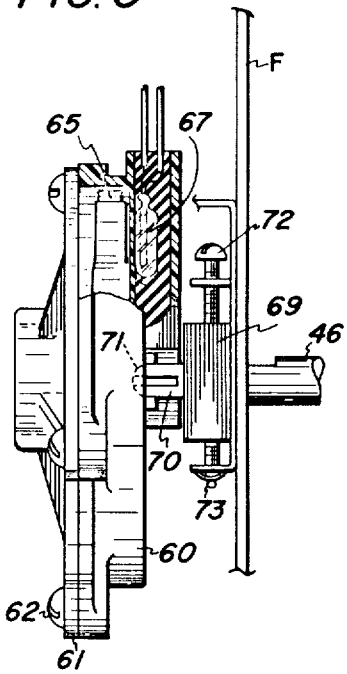
Figure 10:
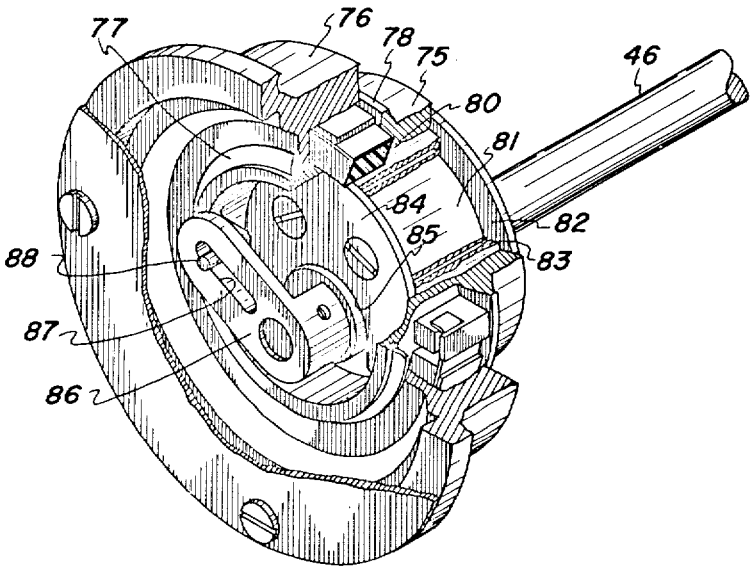
FIG. 10 is an isometric view, partly broken away, of a variable speed imparting device.

In order to provide an adjusting means for the switch 67 relative to the angular orientation of the registration fingers 45 so as to insure proper resetting of the machine control pulse count, the casing 59 may be bodily moved, within narrow limits. Such movement may be necessary in order to arrange the switch elements 68 for actuation at a precise location relative to the magnet 65 the position of which, in turn, is indicative of the angular orientation of the fingers 45. The adjusting means comprises a fixed block 69 mounted on the machine frame F adjacent the casing section 66*a*, and a follower 70 movably retained within the block 69. The follower 70 projects toward the section 60 and is received within a depression 71 formed in this section. Upon vertical movement of the follower 70, as viewed in FIG. 6, in either direction, the casing 59 will be accordingly rotated slightly, as viewed in FIG. 5. In order to impart vertical movement to the follower 70, the block 69 is provided with an adjusting screw 72 for forcing the follower in a downward direction, and an adjusting screw 73 for forcing the follower upwardly. For insuring precise positioning of the casing 59 and consequently, the switch 67, an indicating means, in the form of a pointer 74 secured to the machine frame and indicia 74*a* scribed on the section 60, is provided.

Figure 7:
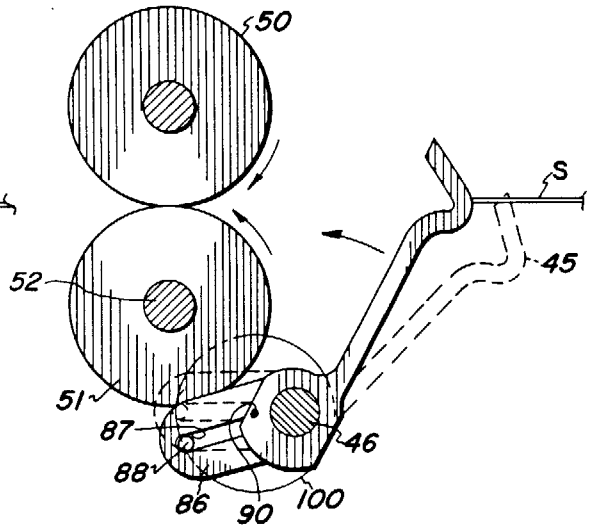
FIGS. 7, 8 and 9 are schematic views of the relative positioning of registration fingers during various sequences of operation.
Figure 8:
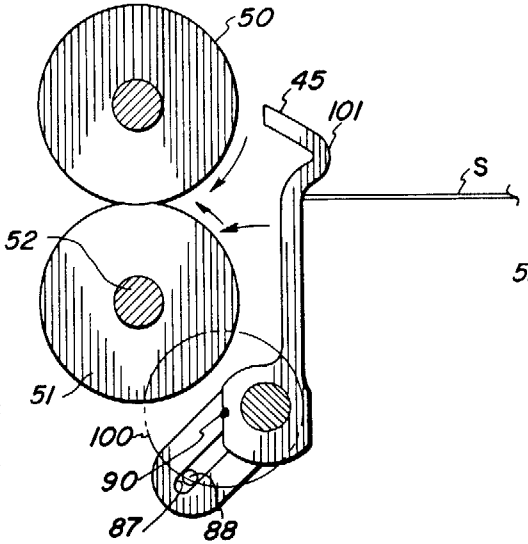
Figure 9:
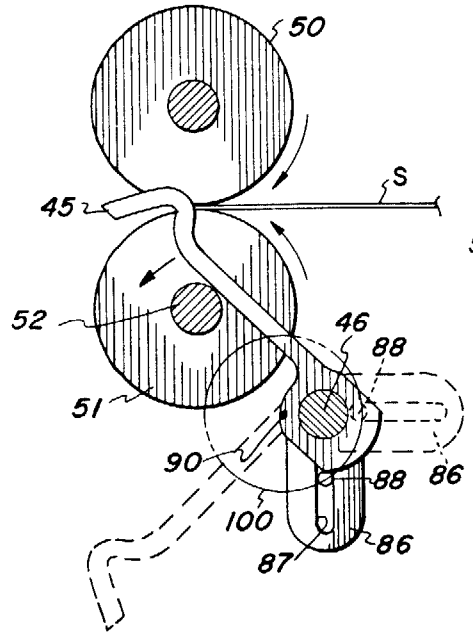

FIGS. 7, 8, and 9 illustrate the cooperative operation of the registration fingers 45, the leading edge of each sheet of paper being registered and fed to the printing machine, and the pinch rollers 50, 51. In FIG. 7, the sheet S, being supplied by either of the sheet supplies 20 or 21 arrives just as the fingers 45 move from its dotted position toward the full line position during rotation of the fingers by the shaft 46. Actually, the sheet may lag slightly in arriving at its illustrated position. At this time, the fingers are moving, in the direction of the arrow, at a speed slightly less than that of the leading edge of the sheet. Rotation of the fingers 45 is accomplished by the constant speed drive motor 30 by way of the drive belt 48 and the variable speed device 47. The device 47, as will be described hereinafter, is adapted to impart to the fingers, rotative speeds which are relatively fast during most of a revolution and slower during other portions of a revolution, and at an increasing speed during sheet registration. During this portion of a revolution, when a sheet is registered "on the fly," the sheet will be fed to the registration station at a higher speed than when it is fed to the processing stations by the pinch rollers 50, 51.

In FIG. 8, the sheet is shown against or going against the fingers and is registered thereby so that the leading edge is free of any skew before entering the processing stations of the machine. The rotative speed of the fingers continues to increase until they reach the full line position shown in FIG. 9. At this instant the fingers are moving at a speed equal to the machine processing speed so that the sheet will be picked up by the pinch rollers 50, 51 for further movement through the machine. After the leading edge of the sheet has been picked up by the pinch rollers, which are running at process speed, the fingers experience a relative fast speed, attaining its maximum speed at about the position shown in dotted lines in FIG. 9. In leaving the leading edge of the sheet in FIG. 9, the fingers 45 must arrive at the position shown in dotted lines in FIG. 7, which is indicative of its slowest speed during a complete revolution, in time to catch the next following sheet. If there is to be precise sheet feed through the processing stations of the machine, each sheet must be precisely spaced one from another as occurs as a result of the registration mechanism herein described. Assuming that the spacing between sheets for very high speed machine operation is to be approximately 1½ inches, it will be apparent that the fingers must move very swiftly through that portion of their revolution when returning from the position shown in FIG. 9 to the position shown in FIG. 7 in order to assure this spacing.

For typical speed relationships for sheet feeding, registration and machine processing, the mechanism so far described is adapted as follows: Assuming the machine processing speed is 20 inches per second; that is, each sheet must be introduced to the transfer nip C at this speed and all other processing stations are functioning approximately at this speed, it is desirable that the sheet supply speed be greater in order to insure time for proper registration and to speed up total machine operation. Greater sheet supply speed also minimizes the effect of inefficiencies or mis-timing in the sheet supplying devices 20, 21. Preferably, the sheet supply feed is approximately 30 inches per second. Under these circumstances, the fingers 45 must slow each sheet from a speed of 30 inches per second to a speed of 20 inches per second in moving through the positions shown in FIGS. 7, 8 and 9. In accomplishing these actions, the fingers as shown in full lines in FIG. 9 are at an effective speed such that the sheet travels at 20 inches per second at the instant when sheet registration occurs, and the reset switch 67 has been actuated. Actually, the speed of the fingers increases slightly in moving from the positions of FIG. 7 to FIG. 9, attaining the process speed at sheet registration. After this occurs, faster increases in finger rotative speed are imparted to the fingers so that at their dotted line positions in FIG. 9, their speed may approximate 40 inches per second, the maximum so attained. After this, the speed may gradually lessen until the dotted position of FIG. 7 is reached wherein the speed may be approximately 18 inches per second, a speed lower than process speed and the minimum for any one complete rotation of the fingers. After leaving the dotted position of FIG. 7, the fingers will be in position to intercept the leading edge of a sheet.

With the sheets being moved to the registration zone, defined by the dotted position of the fingers in FIG. 7, to the full line position of FIG. 9, at a greater speed than process speed, it will be apparent that after the fingers have moved from the dotted line position of FIG. 7, ahead of an oncoming sheet, they will be eventually contacted by the sheet's leading edge as they move from the FIG. 7 position to the FIG. 9 position. This contact may occur any time during this travel, depending upon the efficiency of the sheet supplies and their respective conveying means. It will be appreciated that this arrangement permits the precise registration of each sheet and the precise positioning thereof in the machine processing system for a fairly wide range of inaccurately timed sheet feeding to the registration zone. The defined registration zone then is a registration window having a width in which registration can take place. This window corresponds to approximately 90° of rotation of the fingers and allows a relatively wide margin of error in positioning of sheets of paper by the individual sheet supplies. During this travel of a sheet through the registration zone, it is only necessary that it be in contact with the fingers at the time registration is to be effected.

During movement of each sheet through the registration zone, regardless of when the leading edge contacts the fingers, the speed of the sheet will be slower from its entry speed of 30 inches per second to something less than the process speed of 20 inches per second and then stabilized at the process speed at registration. While at the slower speeds, the sheets will continue to experience a feeding force produced by either of the transport conveyors 40 or 42. During this time, the belts of the transport will slip relative to the adjacent surfaces of the sheets.

In the above description of the speed relationships, various speeds were recited in order to emphasize or illustrate the relationships. The speeds so assigned to this description are only illustrative and need bear no resemblance in fact. What is important are the relationships of the speeds of the moving elements in the descriptions.

As previously stated, the registration fingers 45 rotate with their shaft 46 at variable speeds, and this motion is imparted by way of the variable speed device 47. This device includes an inner cylindrical element 75 which is in the form of a pulley to which the belt 56 is applied for effecting rotation of the pinch rollers 50, 51. Mounted on and exteriorly of the element and concentric therewith, is a circular member 76 which is also in the form of a pulley. The drive belt 48 is applied to this member for imparting, eventually, rotation to the registration fingers 45. The pulley member 76 is rotatably related to and held upon the cylindrical element 75 by a retaining ring 77 on one side and by a flange 78, formed on the element, at the other end. A flexible ring-type clutch element 80 retained between cooperating surfaces of the element 75 and member 76 serves as a clutch therefor. Rotation of the pulley member 76 in one direction will impart rotation to the pulley element 75 in the same direction, but rotation of the pulley member 76 in the reverse direction will have no effect upon the pulley element 75.

The element 75 and therefore the member 76 and clutch element 80 are supported upon a cylindrical retaining block 81 which is formed at one end with a flange 82 arranged to be secured against movement to the machine frame. Surrounding the peripheral surface of the cylindrical block is a circular needle bearing 83 held in place by the flange 82 and a detachable circular plate 84. The inner surface of the element 80 is force fitted to the bearing 83 and in this way the structure 75, 76 and 80 is mounted for rotation upon the fixed block 81.

The block 81 is formed with a through opening 85 having its axis eccentric relative to the axis of the block. The registration shaft 46 projects through this opening and has its axis also eccentric relative to the block 81. At the end of the shaft 46 which terminates within the cylindrical member 76 there is detachably secured an actuator arm 86 so as to be rotatable therewith. The arm 86 is formed with a slot 87 having its longitudinal axis normal to the axis of the shaft 46 so as to be able to define a path of revolution. A drive pin 88, formed on the inner cylindrical surface of the element 75 extends into the slot 87 and is adapted to travel reciprocably therealong. The parts so far described are arranged so that the pulley element 75 and the pulley member 76 have their axes of rotation, designated by the numeral 90, coincident with the axis of the block 81 and eccentric relative to the axis of the shaft 46. During driving rotation of the pulley member 76, the pulley element 75 is driven therewith thereby causing revolving of the drive pin 88 about the axis 90. As the drive pin revolves, it imparts rotation to the arm 86 which in turn, imparts rotation to the shaft 46. Continuous revolving action by the pin 88 at constant speed, and its cooperating reciprocating movement relative to the slot 87, will impart variable speeds of rotation to the registration fingers 45.

In FIGS. 7, 8 and 9, the drive pin 88, the actuating arm 86, the slot 87, the axis 90, and the shaft 46 are shown in their relative positions for imposing the variable rotative motion upon the registration fingers. In FIG. 7, the revolving path of movement 100 for the pin 88 is shown as concentric to the axis 90 and eccentric relative to the axis of the shaft 46. In the dotted position of the arm 86, the rotative speed thereof is slowest and the pin 88 is on one side of the axis 90 or diametrically opposed relative to the axis of the shaft 46. As the pin moves downwardly from this position, the rotational speed of the fingers increases since the pin is moved out of its diametrically opposed relationship and toward a position which is on the same side of the axis 90 as the shaft. In FIG. 8, this repositioning is shown in progress and in FIG. 9, completed. The dotted position of the arm 86 in FIG. 9 is indicative of the highest rotative velocity attained by the registration fingers since the pin 88 and the axis of the shaft 46 are along the same radial line from the axis 90. In approaching this alignment, the rotative speed of the fingers continue to increase as the positioning of the arm 86 in full line attests.

While the rotational velocity of the fingers 45 varies, as described above, the effect of the variation upon a sheet of paper being registered will be modified somewhat. In moving through the registration window, that is, from FIG. 7 to FIG. 9, the effective radius of the fingers 45 relative to the leading edge of a sheet S will also vary. This variation is slight, however, and for that range, its effect will balance out. In moving from the position of FIG. 8 to that of FIG. 9, the critical portion of the window, the rotative velocity of the fingers increases slightly. This slight increase however is factored into the speed relationship of the fingers as they rotate and does not of itself effect sheet speeds.

In order to extend the effectiveness of the window width, that is, provide more width-to-paper-travel, or conversely, less paper-travel-to-width ratio, the fingers are formed with curved surfaces 101 which extend back toward the sheet supplies, to be contacted at different points thereon by each sheet being registered ad they travel through the window. For the illustrated configuration, and for the full window width, distance of movement of the sheet is 10% less than the movement of the fingers. Thus, registration and accurate sheet positioning relative to pitch reset can be accomplished in a shortened distance of paper travel than what would normally be required to accomplish these functions. Or, to put it another way, a longer sheet travel is available for insuring these functions than what would normally be effected if the curved surface 101 were not utilized on the fingers. The surfaces 101 are also arranged so that the leading edge of each sheet will orient as near as possible perpendicular to the surface and not slide off the surface during travel through the registration zone. At the instant a sheet is registered and at the nip of the rollers 50, 51, the surfaces 101 are exactly normal to the plane of the sheet.

The reset switch 67 is in circuit with the pulse counter 37 which may be part of the machine logic LE, and actuation of the switch will initiate pulse re-counting until subsequent actuation, in turn produces corresponding re-counting. In this manner, pitch reset is accomplished off the registration mechanism and is utilized as the starting point, at least countwise, for machine control, processing and sheet monitoring.

The logic equipment LE is operatively connected to the pulse generator 36, the counting mechanism 37, clutches (not shown) for the paper sheet supplies 20, 21, the illumination lamps L to the corotrons 13, 27, the motor for the brush 28, the fuser 24 and the developing apparatus 17, and arranged so that these devices are functionally activated and controlled by a different counted number of the pulses in time sequence. Since the photoreceptor belt 12 is continuously being exposed by flashing imaging rays, the belt may contain a number of electrostatic images, for example, five or more images between the exposure and transfer stations. Similarly, the paper path between the paper supplies and the transfer station C may contain two or three sheets. Any particular time cycle made operative by the timing arrangement may then produce sequential operation of the above-mentioned devices in an order which affects different images, transfer operations and sheets of paper. In other words, the programming control system will maintain timing control for five or more pitches concurrently processwise. For instance, after the machine has been turned "On" and the drive means 30 is in full drive operation so that control pulses are being produced, counted and reset by the reset switch 67, and the registration fingers are rotating, poised for the expectant sheets, the lamps L may be energized as the first event when the machine is placed in "print" condition. It will be noted that upon initial machine use, a sheet S will not have been separated from one of its supply stacks before the first "flash" of an original D is made. In fact, there may be experienced two or three image exposures on the belt 12 before the first sheet is separated from a stack by one of the control pulses in the control signal. The first of a series of produced latent images may be in or nearing the developing zone, and as images are so produced, the first one, now developed, is adjacent the transfer station in timed relationship to a sheet being registered. The short distance yet to travel after the registration fingers 45 leave the sheet is factored into the pitch distance belt 12 travels so that the developed image and the exact positioning it is to occupy on the sheet will be in precise registration at transfer. During the actuation of these process divices, other devices may be activated to continue the processing of reproductions. For example, all the corotrons would have been energized as well as the paper jam detection devices (not shown) located along the paper path of movement may be sensed in sequence for the different sheets of paper in the path in order to insure the proper positioning of the sheets. The fuser apparatus would have been energized before the first sheet arrived there and successive energization of the cleaning and discharging elements also would have occurred. Upon release of the sheet of paper from the nip at station C, the cycle begins again and will produce the indentical series of operations as discussed above.

While the invention has been described with reference to the structure disclosed, it is not confined to the details set forth but is intended to cover such modifications or changes as may come within the scope of the following claims.

What is claimed is:

1. A reproduction machine having a plurality of processing stations to produce a developed latent image on a moving photoreceptor member for transferral to a sheet of copy paper, and a programming system for controlling operation of the processing stations in timed sequence relative to the movement of the photoreceptor member including:

a plurality of copy paper supply sources, each having a stack of paper sheets and a sheet separating device;

a sheet conveying mechanism associated with each of said paper sources whereby sheets separated from the stacks are transported therefrom by their respective conveying mechanisms;

registration means associated with said sheet conveying mechanisms for registering and aligning each sheet presented to said registration means by said conveying mechanisms, drive means for moving said registration means at a speed such that registration and alignment of the sheet occurs at a linear sheet speed substantially equal to the linear speed of the photoreceptor member; and, control means operatively connected to the machine programming system and said sheet separating devices to actuate said sheet separating devices at a predetermined point in the process of producing a developed image irrespective of the paper supply source being utilized, said sheet conveying mechanisms and said paper supply sources being arranged such that the sheets separated from said sources arrive at the registration means at the same predetermined time after actuation of the sheet separating devices associated therewith, thereby allowing the same timed relationship between actuation of any of the sheet separating devices and the registration of said sheets to allow sequential operation of the separating devices without requiring a change in machine timing.

2. A reproduction machine having a plurality of processing stations to produce a developed latent image on a moving photoreceptor member for transferral to a sheet of copy paper, and a programming system for controlling operation of the processing stations in timed sequence relative to the movement of the photoreceptor member including:

a plurality of copy paper supply sources, each having a stack of paper sheets and a sheet separating device, one of said paper sources having a primary sheet conveying mechanism associated therewith whereby sheets separated from said one paper source are transported therefrom, the remainder of said paper supply sources each having a secondary conveying mechanism associated therewith whereby sheets separated from the stacks are transported therefrom by their respective secondary conveying mechanism, said secondary conveying mechanisms being arranged for conveying sheets to said primary conveying mechanism for permitting conveyance thereby of all sheets during a portion of their path of movement;

registration means positioned in the machine for registering and aligning each sheet received from said primary conveying mechanism, means for driving said registration means at a speed such that registration and alignment of the sheets occurs at a linear speed substantially equal to the linear speed of the photoreceptor member for delivery of sheets from the registration means to the photoreceptor at the linear speed of the photoreceptor, and control means operatively connected to the machine programming system and said sheet separating devices to actuate said sheet separating devices at a predetermined point in the process of producing the developed image irrespective of the paper supply source being utilized, said sheet conveying mechanism and said paper supply sources being located such that the sheets separated from said supply sources arrive at the registration means at the same predetermined time after actuation of the sheet separating device associated therewith, thereby allowing the same timed relationship between actuation of any of the sheet separating devices and the registration of said sheets to allow sequential operation of the separating devices without requiring a change in machine timing.

3. A reproduction machine having a plurality of processing stations to produce a developed latent image on a moving photoreceptor member for transferral to suitable image support material, and a programming system for controlling operation of the processing stations in timed sequence relative to the movement of the photoreceptor member including:

a plurality of support material sources;

continuously rotating registration fingers positioned in the machine for registering and aligning individual sheets of support material;

means for rotating said registration fingers at a variable speed, the lowest circumferential speed attained by said registration fingers being substantially equal to the linear speed of the photoreceptor member to provide for registration and alignment of the support material at a linear speed substantially equal to the linear speed of the photoreceptor member prior to delivery of the support material to the photoreceptor member;

support material supplying means associated with each of said support material sources whereby support material from said sources is fed therefrom to said registration means; and control means operatively connected to the machine programming and said support material supplying means to move said support material from its source at a predetermined point in the process of producing the developed image irrespective of the source being utilized, said supplying means and said sources being arranged such that the material separated therefrom arrives at the registration means at the same predetermined time after leaving its source irrespective of its source, thereby allowing the same timed relationship between movement of the material from any of said sources and the registration of said material to allow utilization of any of said sources without requiring a change in machine timing.

* * * * *